United States Patent [19]

Nyström

[11] Patent Number: 4,606,259

[45] Date of Patent: Aug. 19, 1986

[54] AIR CURTAIN

[75] Inventor: Karl G. Nyström, Växjö, Sweden

[73] Assignee: Flakt Aktiebolag, Nacka, Sweden

[21] Appl. No.: 762,929

[22] Filed: Aug. 6, 1985

[30] Foreign Application Priority Data

Aug. 7, 1985 [SE] Sweden ..... 8403995

[51] Int. Cl.[4] ..... F24F 9/00

[52] U.S. Cl. ..... 98/36; 98/40.18; 55/DIG. 29

[58] Field of Search ..... 98/36, 40.18; 55/DIG. 29

[56] References Cited

U.S. PATENT DOCUMENTS

| | | | |
|---|---|---|---|
| 2,935,925 | 5/1960 | D'Ooge | 98/36 |
| 3,380,369 | 4/1968 | Allander | 98/36 |
| 3,726,204 | 4/1973 | Lindestrom | 98/36 |
| 3,747,505 | 7/1973 | Turko | 98/115.3 |
| 3,803,995 | 4/1974 | Allander | 98/36 |
| 4,048,912 | 9/1977 | Walker | 98/36 |
| 4,131,059 | 12/1978 | Gustavsson | 98/36 |
| 4,467,612 | 8/1984 | Weasel, Jr. | 62/91 |

FOREIGN PATENT DOCUMENTS

| | | |
|---|---|---|
| 2729441 | 1/1979 | Fed. Rep. of Germany . |
| 549760 | 5/1974 | Switzerland . |

*Primary Examiner*—Ronald C. Capossela

*Attorney, Agent, or Firm*—Dann, Dorfman, Herrell and Skillman

[57] ABSTRACT

An air curtain (1) established in a free air space (2) by allowing partly a first air current to pass one or a plurality of nozzles and to form one or a plurality of directed narrow air jets and partly a second air current by means of co-ejection to form a surface layer for the air curtain facing towards the free air space or space. Means (6) are provided to be able to form an air circulation in the air space in a direction counter to that of the air circulation (24, 25) which the surface layer for the air curtain tends to give the air in the air space (2). The free air space can be limited by ceiling, floor and walls in the machine hall, where one or several machines (22, 23) or other devices during operation emit air with high humidity and high temperature. In such an application the air curtain is established from the ceiling and directed downwards to act adjacent to the machines (22, 23). The second air current is wholly or partly extracted from available inter-roof air (12) and/or available outdoor air.

9 Claims, 4 Drawing Figures

AIR CURTAIN

TECHNICAL FIELD

The present invention relates to a formation of an air curtain in a free air space. A free air space is defined as an air space in which an established air curtain will not be restricted and directed by mechanical means such as screens, walls etc.

The air curtain will be established by permitting a first air current to pass through one or a plurality of nozzles thus forming one or a plurality of directed narrow air jets and arranging so that these narrow air jets by means of co-ejection cause a second air current to also form the said air curtain and then especially the surface layer of the air curtain facing towards the free air space.

DESCRIPTION OF THE PRIOR ART

Formation of an air curtain in a free air space by utilizing one or a plurality of directed narrow air jets is already known per se.

As an example of the prior art mention may be made here of a device for ventilation of a room and for generation of special air currents with higher velocity, shown and described in Swedish patent specification No. 431 790.

Indicated here is a device for establishment of an air cushion for separation or limitation of certain room zones.

Indicated here is an air directing means with nozzles which are fed by a fan.

A limitation of the said room is elaborated largely in its entirety as a perforated surface in a ceiling for passage of ventilation currents with relatively low or normal velocity. Disposed behind the ceiling is a cavity which is fed by the said fan.

Indicated specially here is that the controlling means shall be removable and movable on the room side of the stipulated limitation, i.e. applicable on arbitrary places on the whole of the perforated surface and display a box-like shape. This box-like shape presents a large open side for direct and sealing connection to the perforated surface for screening off of a surface sector and collection of the ventilation air currents penetrating through the perforated surface and into the box with lower or normal velocity and conversion thereof to the said special air currents with a higher velocity for departure through the said nozzles or the controling means or the like in the desired direction while at the same time the portion of the perforated area which is not affected by the controlling means is designed in a prior art manner for generation of the said ventilation air currents.

Also state of prior art is the device shown and described in the German patent specification No. 27 29 441 where the device is to be utilized for ventilation and conditioning of a limited space.

In this space at least one heat source shall be disposed at a distance from the roof so that cold air can flow from a zone above the heat source downwards so that the heated air above the heat source is removed.

Here, heating is to take place of large workshop halls so that a heat radiation from a large height can be directed towards the floor surface of the hall and machines located there through admission of fresh air from the outer atmosphere from above and with the task of allowing a fresh air supply device to be disposed between the heat radiator and evacuation means oriented close to the fresh air supply.

DESCRIPTION OF THE PRESENT INVENTION

Technical Problem

In view of the prior art the ability to create such prerequisites that an established air curtain on the one hand is given a sufficient inner air flow velocity to be able to establish an air curtain but nevertheless not give rise to excessively strong whirling of air situated within the surrounding air space must be regarded as a technical problem.

In view of the fact that the velocity of the air current in an established air curtain will be higher in the vicinity of nozzles and outlet openings than at a further distance from the nozzles it is a technical problem to be able to create prerequisites to reduce the formation of whirls of air situated within the surrounding air space and in the immediate vicinity of these nozzles or outlet openings.

In such free air spaces which are confined by ceiling, floor, and walls, particularly a machine hall for the production of paper pulp, paper etc., where the machines for their operation emit air with high humidity and high heat (steam) it is a technical problem to be able to accomplish effective ventilation without excessively large energy losses and without draughts being felt by the personnel working in the machine hall.

In machine halls of the nature described hereto fore it is a technical problem to be able to create prerequisites to accomplish an air ventilation facility which does not to some extent cover the floor space between erected machines.

It is also a technical problem to be able to create efficient ventilation and conditioning of only the air volume around the working personnel without therefore having to waive the requirement of maintaining a temperature exceeding the dew point at the ceiling.

In machine halls of the nature described heretofore it is a qualified technical problem to be able in a simple manner to create prerequisites for the establishment of an air curtain with a low air velocity from a dry and/or conditioned or heated air current.

It is a technical problem to be able to create such prerequisites that the established air curtain is able to function without appreciably creating an undesirable air circulation of the air volume in the surrounding air space. It is particularly important to create these prerequisites in the vicinity of the nozzles or where the air in the air curtain has a high velocity.

Finally it must be regarded as a technical problem to be able with simple means to create prerequisites to counteract an undesirable air circulation in the vicinity of the ceiling generated by the friction of the air curtain against the surrounding air.

Yet another technical problem lies in being able in a simple manner to exploit dry and conditioned air already available in the premises and to cause this air to surround the personnel working in the premises without these experiencing a draught.

It is also a technical problem to be able to create a facility for the specified purpose in which the included components can be applied in a simple manner to existing buildings.

SOLUTION

The present invention now indicates a possibility of establishing an air curtain in a free air space by allowing partly a first air current to pass one or a plurality of nozzles and to form one or a plurality of directed narrow air jets and partly to permit a second air current by means of co-ejection to form a surface layer for the air curtain facing towards the free air space.

According to the invention it is specified that a means shall be provided to be able to form an air circulation in the air space directed counter to the air circulation that the friction of the surface layer for the air curtain tends to give the air in the air space.

The means shall be disposed so as to be able to reduce and/or prevent an air circulation of that portion of the air space surrounding the air curtain that is situated adjacent to the nozzles.

The co-ejected second air current is conditioned and/or moisture-controlled.

It is also directed that the co-ejected second air current be supplied to the air curtain via a funnel-shaped hood with the wider opening facing towards the air curtain and with a fan device acting in the narrower opening of the funnel-shaped hood.

In particular, the invention specifies that such an established air curtain will have a specially appropriate application in a machine hall for the manufacture of paper pulp or paper where the machine during operation and for its operation emits air with high humidity and high temperature (steam) in that the air curtain can be established from the ceiling and directed downwards in order to provide a comfort zone in the vicinity of the machine or between two machines.

The second air current can then entirely or partly be extracted from available inter-roof air and/or available outdoor air. The first air current can also be extracted from inter-roof air and/or outdoor air.

The invention specifies particularly that an additional air current is arranged to be directed at an angle, preferably a right angle, to the first air current and to the second air current and that this air current can be directed along a ceiling.

Finally it is specified that a peripheral opening in an edge section directs the additional air current along a plane oriented parallel to the plane of a ceiling.

ADVANTAGES

The advantages which may primarily be considered to be associated with the present invention is that possibilities are created hereby for establishing an air curtain without detriment to air circulation of the surrounding air volume. In a machine hall for the production paper pulp or paper working personnel can work in a dry and conditioned air curtain without a part of the free floor area being covered with complete or parts of air conditioning facilities which usually generate a conditioned air current which is experienced as draught.

The features which may primarily be regarded as significant for an air curtain according to the present invention are specified below.

SHORT DESCRIPTION OF THE DRAWINGS

A currently proposed embodiment possessing the characteristics significant for the present invention will now be more closely described with reference to the accompanying drawing, wherein FIG. 1 shows a first side view of a device for formation of an air curtain according to the invention, FIG. 2 shows a second side view of the device according to FIG. 1, FIG. 3 shows in a slightly enlarged scale a part encircled by broken lines in FIG. 1 which has a design permitting a generation of an additional air current directed along a ceiling and FIG. 4 shows the location of the device in a ceiling in a machine hall with two machines for the manufacture of paper pulp and an assumed air circulation of the surrounding air volume in a free air room.

DESCRIPTION OF THE EMBODIMENT

Figure 1:
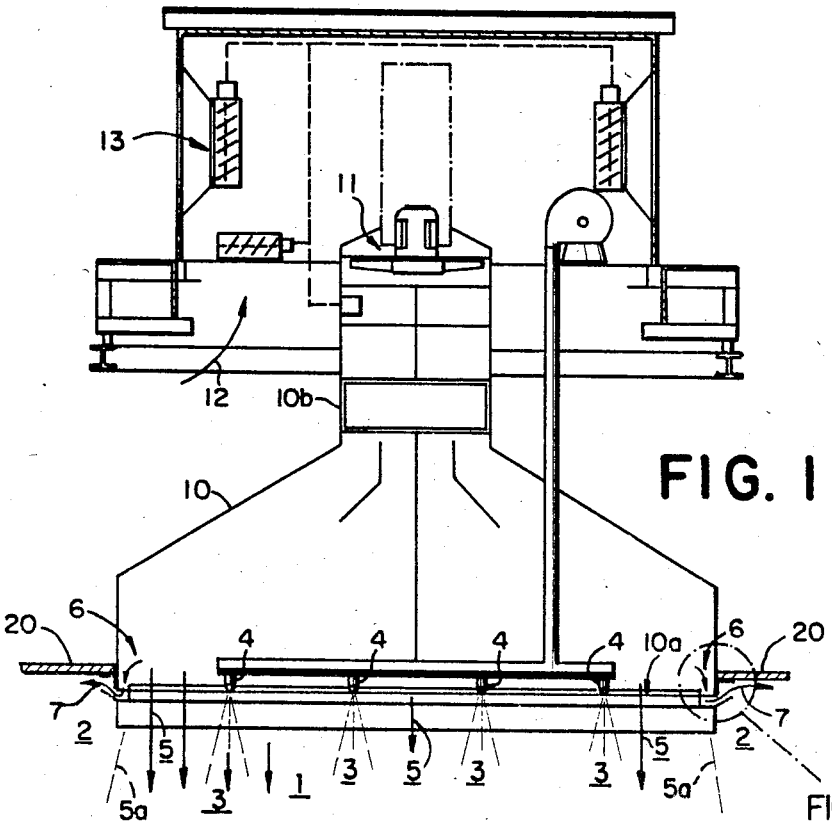
Figure 2:
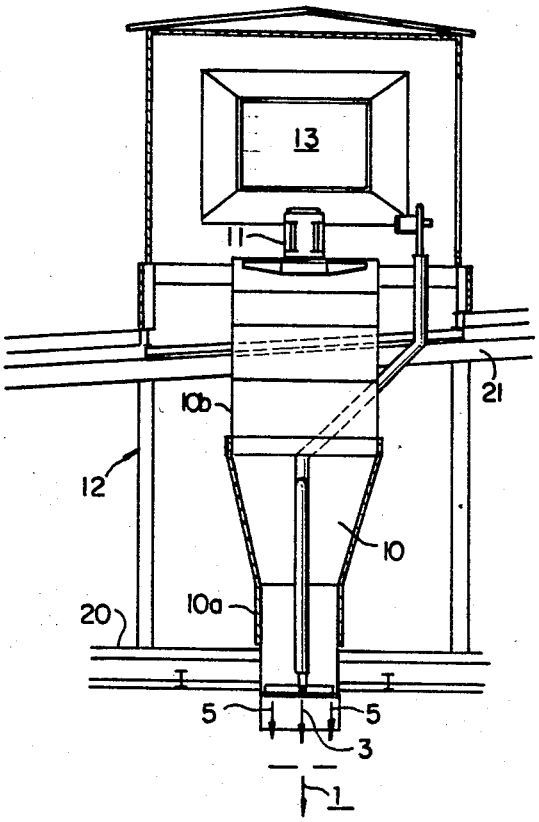

With reference to FIG. 1 and FIG. 2 there are shown two different side views of a device which is designed to be able to create an air curtain 1. This air curtain 1 is established in a free air space 2 by permitting partly a first air current 3 to pass one or a plurality of nozzles 4 and in so doing to form one or a plurality of directed narrow air jets and partly a second air current 5 which by means of co-ejection establishes an air current on the outside of the directed narrow air jets 3. This second air current 5 establishes at reference designation **5*a* a surface layer for the air curtain 1 facing towards the free air space 2**.

According to the invention it is specified that means 6 shall be provided in order to be able to establish an air circulation in the air space with reference designation 7 in a direction counter to that of the air circulation as indicated at 24 and 25 which the friction of the surface layer **5*a* for the air curtain tends to give adjacent air in the air space 2, at least in connection with the nozzles 4 and where the air velocity for the second air current 5** is high.

The means 6 is arranged to be able to decrease and/or prevent an air circulation of especially that part of the air curtain surrounding the air space which is situated adjacent to the nozzles 4.

It is further proposed that the first air current and/or the second air current, preferably only the second air current, shall be conditioned and/or humidity-controlled.

Here, the air in the air curtain shall thus be of a temperature indicating well adapted dryness and comfort.

The co-ejected second air current 5 is supplied to the air curtain 1 via a funnel-shaped hood 10, with the wider opening **10*a* facing towards the air curtain and with a fan device 11 acting in the narrower opening 10*b* of the funnel-shaped hood 10**.

The second air current is formed by mixing a proportion of inter-roof air via the air current 12 with a portion of fresh air via the air current 13. It is assumed that the inter-roof air via means not shown in detail is made to be dry and that the mixing can take place in proportions giving the desired temperature via means which also are not shown in detail.

Figure 3:
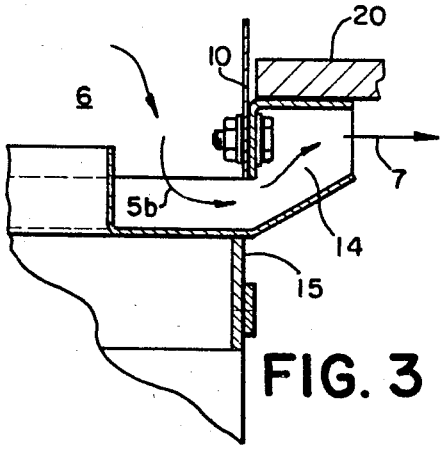

According to the invention means 6—shown in a slightly enlarged scale in FIG. 3—are specified which shall be able to establish an air circulation in the air space 2 in a direction counter to the air circulation which the friction of the surface layer **5*a* for the air curtain tends to give. This means consists of a peripheral opening 14 in an edge section 15 for the funnel-shaped hood 10. Hereby a part 5*b* of the co-ejected air current 5 will pass the said opening and direct this additional air current 7 along a plane parallel to the plane of a ceiling 20**.

The additional air current **5*b* will be directed at an angle, preferably a right angle, to the first and the second air current. The embodiment example specifies that the additional air current 5b shall be oriented along a ceiling 20**.

Figure 4:
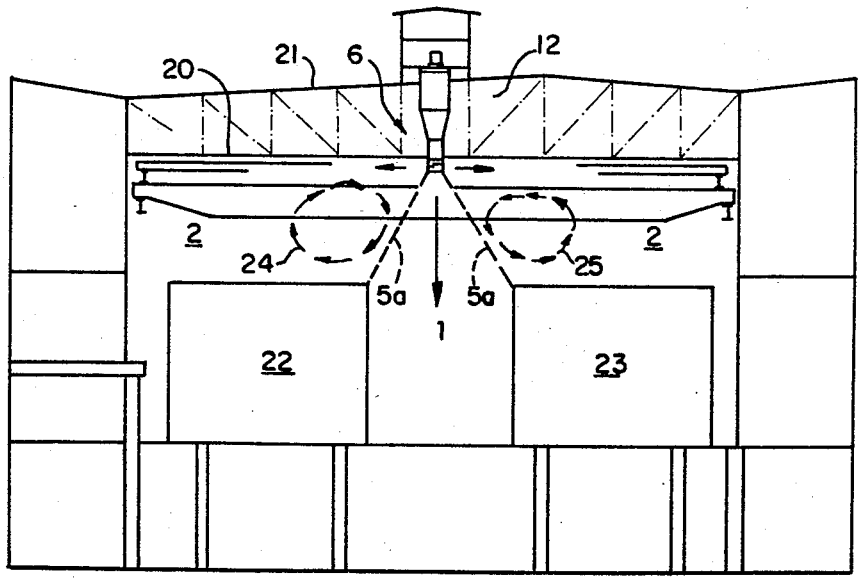

The invention will have a specially suitable application when it is a matter of establishing a large air curtain around personnel working in a machine hall, in which the free air space is confined by ceiling, floor and walls according to FIG. 4. In the machine hall there may be machines or other devices which during operation emit air with high humidity and high temperature. Examples of such machines are paper pulp machines, paper machines and the like.

In such an application the air curtain shall be established from the ceiling 20 and be directed downwards towards the machine and personnel, specially directed to become established between two machines, 22, 23 to provide a comfort zone for the personnel attending the machine. The second air current shall then be able to be taken out entirely or partly from available inter-roof air 12 and if necessary be mixed with fresh outdoor air.

Through this arrangement it is obvious that the air circulation that will be generated by the friction of the surface layer for the air curtain in adjacent air in the air room will be limited, if not entirely eliminated, in the vicinity of the ceiling 20 and if any air circulation occurs the shown air circulations 24 and 25 will be situated immediately above the machines 22 and 23. Between the machines 22, 23, in the comfort zone where personnel are stationed, there will be no or only limited air circulation of the air space since the air curtain shall cover the entire intermediate space and go far from the nozzles 4 and the air velocity in the air curtain will be little and not annoyingly perceptible.

It thus becomes evident that for an application in which only the far part of the air curtain shall be oriented between two machines or between one machine and a wall section the technical effect occurs that a slowly evacuated air curtain will be established in the vicinity of the machine where the air curtain has a somewhat higher pressure than the air pressure in the machines.

Evacuation of the air curtain will then take place through apertures in the machine or their coverings and the air with high humidity and high temperature generated during operation of the machines will be pressed by the higher pressure of the air curtain in a direction away from the air curtain and usually upwards towards the ceiling.

The design described here may be regarded as elaborated for simple assembly also in already existing buildings, since a house with two fans can be mounted on the roof. A lower part is light and can be applied between the roof and the house as well as a ceiling. Only nozzles etc. shall extend beyond the ceiling.

The invention is obviously not restricted to the embodiment described above as an example but can undergo modifications within the scope of the inventive concept illustrated in the accompanying claims.

What is claimed is:

1. Apparatus to establish an air curtain in a free air space comprising nozzle means, supply means to cause a first air current to pass through said nozzle means and to form in said curtain at least one directed narrow air jet, and ejection means to cause a second air current by means of co-ejection to establish a surface layer for the air curtain in the form of a first circulation path in the free air space extending along said curtain and back to said nozzle means, characterized in that means are provided to form a third air current in a second air circulation path adjacent said nozzle means in the air space in a direction counter to the first circulation path to thereby diminish the air circulating in said first path.

2. An air curtain apparatus according to claim 1, characterized in that means is provided upstream of said ejection means to condition and/or control the humidity of the co-ejected second air current.

3. An air curtain apparatus as claimed in claim 1, characterized in that said ejection means comprises an inverted funnel-shaped hood with its wider opening facing towards the air curtain and having fan means in the narrower opening of the funnel-shaped hood.

4. A method of forming an air curtain established in a free air space restricted by ceiling, floor and walls in a machine hall where at least one device during operation emits air with high humidity and high temperature, using nozzle means to cause a first air current to form at least one directed narrow air jet in an air curtain, and supplying a second air current by means of co-ejection to form a surface layer alongside the air curtain facing towards the free air space, characterized in that the air curtain is established from the ceiling and is directed downwards to provide a comfort zone in the vicinity of said at least one device and in that air for the second air current is extracted from available inter-roof air and/or available outdoor air, and is caused to flow in a circulation path downwardly alongside the air curtain, outwardly along said at least one device, upwardly and then inwardly along the ceiling.

5. A method according to claim 4 characterized in that the air curtain is established by using air which is dry and/or heated.

6. A method according to claim 4 characterized in that an additional air current is directed at an angle to the first air current and in a flow direction opposite to the direction of the second air current in its circulation path.

7. A method according to claim 6, characterized in that the additional air current is oriented on the underside of and directed outwardly along the ceiling.

8. A method according to claim 6, characterized in that the additional air current is taken from the air extracted for the second air current and is directed along a plane parallel with the plane of a ceiling.

9. A method according to claim 4, including the step of causing the air curtain to display a higher air pressure adjacent the said device than the air pressure inside the device.

* * * * *